US012638229B2

(12) United States Patent
Schmidt et al.

(10) Patent No.: US 12,638,229 B2
(45) Date of Patent: May 26, 2026

(54) HEAT PUMP

(71) Applicant: VIESSMANN CLIMATE SOLUTIONS SE, Allendorf (DE)

(72) Inventors: Thorsten Schmidt, Marburg (DE); Eduard Lang, Allendorf (DE)

(73) Assignee: VIESSMANN CLIMATE SOLUTIONS SE, Allendorf (DE)

( * ) Notice: Subject to any disclaimer, the term of this patent is extended or adjusted under 35 U.S.C. 154(b) by 183 days.

(21) Appl. No.: 18/276,507

(22) PCT Filed: Jan. 27, 2022

(86) PCT No.: PCT/DE2022/100072

§ 371 (c)(1),
(2) Date: Aug. 9, 2023

(87) PCT Pub. No.: WO2022/171236

PCT Pub. Date: Aug. 18, 2022

(65) Prior Publication Data

US 2024/0310106 A1 Sep. 19, 2024

(30) Foreign Application Priority Data

Feb. 10, 2021 (DE) ..... 10 2021 103 066.8

(51) Int. Cl.
*F25D 23/00* (2006.01)
*F25B 30/02* (2006.01)

(52) U.S. Cl.
CPC ..... *F25D 23/006* (2013.01); *F25B 30/02* (2013.01); *F25B 2500/13* (2013.01)

(58) Field of Classification Search
CPC ..... F25B 30/02; F25B 41/40; F25B 23/006; F25B 2500/12; F25B 2500/13
See application file for complete search history.

(56) References Cited

U.S. PATENT DOCUMENTS 5,596,879 A * 1/1997 Burkhart ..... F04B 39/0055 415/119
6,260,373 B1 7/2001 Rockwood
(Continued)

FOREIGN PATENT DOCUMENTS

DE 600 29 497 T2 5/2007
DE 10 2018 115 749 A1 1/2020
(Continued)

OTHER PUBLICATIONS

International Search Report in PCT/DE2022/100087, mailed May 11, 2022.
(Continued)

*Primary Examiner* — Tavia Sullens
(74) *Attorney, Agent, or Firm* — Collard & Roe, P.C.

(57) ABSTRACT

A heat pump includes a compressor for compressing refrigerant, which compressor operates within an operating speed range and in so doing causes at least one disturbance frequency of the first order, and the heat pump comprising further heat pump components which are disposed on a support element and through which refrigerant flows as well. A unit composed of the support element and the heat pump components disposed thereon has a first natural frequency which is greater than the disturbance frequency of the first order transmitted by the compressor operating in the operating speed range to the unit acting as a rigid body.

15 Claims, 4 Drawing Sheets

(56) References Cited

U.S. PATENT DOCUMENTS

| | | | | |
|---|---|---|---|---|
| 2002/0088237 | A1* | 7/2002 | Rudick | F25D 23/006 62/295 |
| 2018/0339716 | A1 | 11/2018 | Tanaka et al. | |

FOREIGN PATENT DOCUMENTS

| | | | |
|---|---|---|---|
| EP | 1 018 627 | A2 | 7/2000 |
| EP | 3 381 724 | A1 | 10/2018 |
| EP | 3 789 696 | A1 | 3/2021 |
| KR | 10-2018-0070050 | A | 6/2018 |
| WO | 2019/211894 | A1 | 11/2019 |

OTHER PUBLICATIONS

International Search Report in PCT/DE2022/100072, mailed May 13, 2022.

English translation of the International Preliminary Report on Patentability and Written Opinion of the International Searching Authority in PCT/DE2022/100087, mailed Aug. 24, 2023.

English translation of the International Preliminary Report on Patentability and Written Opinion of the International Searching Authority in PCT/DE2022/100072, mailed Aug. 24, 2023.

* cited by examiner

HEAT PUMP

CROSS REFERENCE TO RELATED APPLICATIONS

This application is the National Stage of PCT/DE2022/100072 filed on Jan. 27, 2022, which claims priority under 35 U.S.C. § 119 of German Application No. 10 2021 103 066.8 filed on Feb. 10, 2021, the disclosure of which is incorporated by reference. The international application under PCT article 21(2) was not published in English.

BACKGROUND OF THE INVENTION

1. Field of the Invention

The invention relates to a heat pump.

2. Description of the Related Art

A heat pump of the type mentioned in the introduction is disclosed in the patent document DE 10 2018 115 749 A1. This heat pump consists of a compressor for compressing refrigerant, which compressor operates within an operating speed range and in doing so causes at least one disturbance frequency of the first order, and the heat pump comprising further heat pump components which are disposed on a support element and through which refrigerant flows as well.

SUMMARY OF THE INVENTION

The object of the invention is to improve a heat pump of the type mentioned in the introduction. In particular, a heat pump which operates even more quietly is intended to be provided.

This object is achieved with a heat pump according to the invention.

According to the invention, it is thus provided that a unit composed of the support element and the heat pump components disposed thereon has a first natural frequency which is greater than the disturbance frequency of the first order transmitted by the compressor operating within the operating speed range to the unit acting as a rigid body.

In other words, the solution according to the invention is thus characterized in that the unit consisting of the support element and the further heat pump components has a (particularly) high degree of stiffness, such that ultimately it behaves (at least approximately) as a rigid body at least within the operating speed range of the compressor and thus-since it does not vibrate itself—is particularly quiet or causes no noise.

In all of the above, naturally the compressor within its operating speed range (preferably between 700 and 7200 revolutions) also causes vibrations of other orders (second, third, etc.) in addition to the disturbance frequency of the first order (i.e. between approximately 12 and 120 Hertz). In principle, it might also be desirable that the natural frequency of the unit according to the invention, in particular, is also above the disturbance frequency of the second order; but since the latter is significantly higher (than that of the first order), this could be technically very complex. However, it is also advantageous that the amplitude of the disturbance frequency becomes smaller and smaller with the increasing order, i.e. the proviso according to the invention already provides quite a significant noise reduction.

Further advantageous developments of the heat pump according to the invention are found below.

For the sake of completeness, reference is also made to the patent document US 2018/0339716 A1. In this solution, however, only the support element (called the "base" therein) and not a unit consisting of the support element and the heat pump components disposed thereon (called the "accumulator" therein) has a higher natural frequency than the disturbance frequency transmitted by the compressor.

BRIEF DESCRIPTION OF THE DRAWINGS

The heat pump according to the invention, including its advantageous developments according to the dependent claims, is explained in more detail hereinafter with reference to the graphic representation of various exemplary embodiments.

In the Drawings

DETAILED DESCRIPTION OF THE PREFERRED EMBODIMENTS

Figure 1:
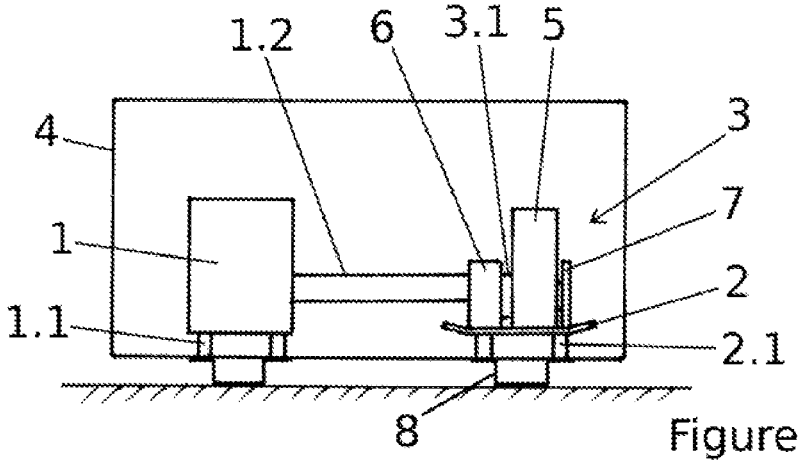
FIG. 1 shows schematically the heat pump according to the invention with the unit consisting of the support element and the heat pump components and configured as a rigid body.

The heat pump shown in the figures firstly consists in a manner known per se of a compressor 1 for compressing refrigerant, which compressor operates within an operating speed range and in so doing causes at least one disturbance frequency of the first order, and the heat pump comprises further heat pump components 3 which are disposed on a support element 2 and through which refrigerant flows as well.

Considered in more detail, it is preferably provided that at least one heat exchanger 5, a valve device 6 (or valve changeover device) and/or an expansion device 7 are selectively disposed on the support element 2.

It is essential for the heat pump according to the invention that a unit composed of the support element 2 and the heat pump components 3 disposed thereon has a first natural frequency which is greater than the disturbance frequency of the first order transmitted by the compressor 1 operating within the operating speed range to the unit acting as a rigid body.

It is particularly preferably provided that the compressor 1 has an operating speed range of 700 to 7200 revolutions per minute, particularly preferably of 800 to 6900 revolutions per minute, quite particularly preferably of 900 to 6600 revolutions per minute.

Moreover, it is particularly preferably provided that the unit consisting of the support element 2 and the heat pump components 3 disposed thereon has a first natural frequency of more than 100 Hz, particularly preferably of more than 120 Hz, quite particularly preferably of more than 140 Hz.

In order to work towards the aforementioned condition according to the invention, it is also particularly preferably provided that the support element 2 (already) has a first natural frequency which is greater than the disturbance frequency of the first order caused by the compressor 1 operating within the operating speed range.

In order to work further towards the aforementioned condition according to the invention, it is also particularly preferably provided that each heat pump component 3 has a first natural frequency which is greater than the disturbance frequency of the first order caused by the compressor 1 operating within the operating speed range.

In the event that there is also the requirement for action, due to a corresponding material selection of the pipework 3.1 of the heat pump components 3, it is also particularly preferably provided that the unit, including the pipework 3.1 of the heat pump components 3, has a first natural frequency which is greater than the disturbance frequency of the first order transmitted by the compressor 1 operating within the operating speed range to the unit acting as a rigid body.

In other words, according to the invention it is thus provided that in principle a coupled natural frequency of the entire unit is determined or designed on the basis of the local natural frequencies of the individual components such that this is above the first-order disturbance frequency of the compressor 1.

Thus, for example, to increase the local natural frequency, as shown in FIG. 1, it is also provided that the support element 2 is configured as a plate with a bent edge 2.2 (see also FIG. 4) for increasing its natural frequency. Moreover, it can preferably be provided that the support element 2 is configured to be thicker than is required for the actual loading.

As visible in FIG. 1, it is also preferably provided that the compressor 1 is configured to be fastened via one (typically—as also shown—a plurality of) spring element (s) 1.1 to a housing 4 of the heat pump. In a comparable manner, it is also preferably provided that the support element 2 is configured to be fastened to a housing 4 of the heat pump via one (or a plurality of) spring element (s) 2.1.

It is also particularly preferably provided that the spring element 1.1, 2.1 is at least partially formed from an elastomer, preferably from polyurethane foam.

It is also preferably provided that the compressor 1 and the unit, apart from a required fluid line 1.2 between the compressor 1 and the unit, are configured to be capable of vibration independently of one another.

Finally, in order to ensure a uniform loading of the spring element (s) 2.1, it is particularly preferably provided that a centre of gravity of the unit is selected—by a suitable arrangement of the heat pump components 3—such that a weight force is vertically introduced into the spring element (s) 2.1.

Figure 2:
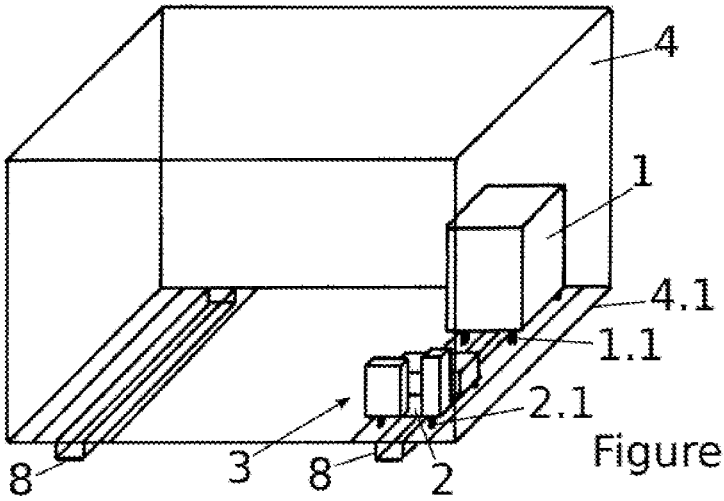
FIG. 2 shows in perspective a heat pump with a support element for the heat pump components.
Figure 3:
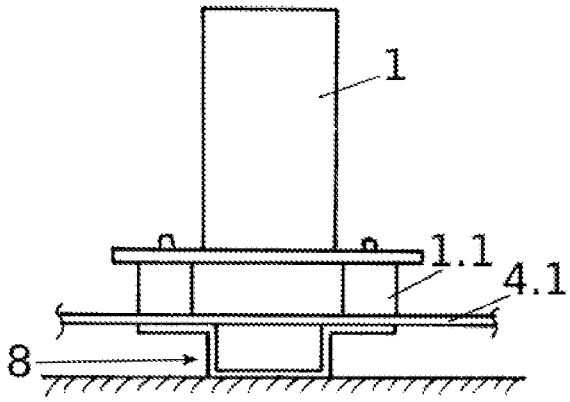
FIG. 3 shows in side view the compressor of the heat pump according to FIG. 2 positioned on a load transfer element.
Figure 4:
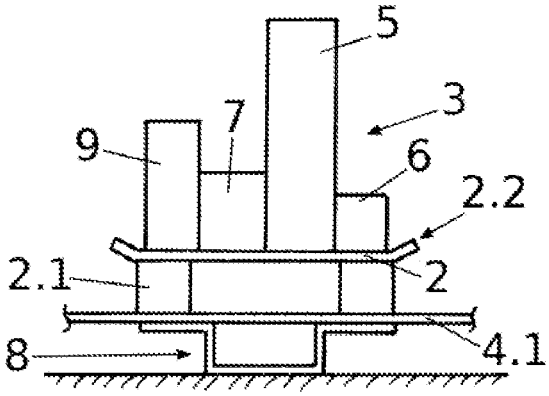
FIG. 4 shows in side view the support element with the heat pump components of the heat pump according to FIG. 2 positioned on a load transfer element.

Moreover, it is also preferably provided:

The heat pump shown in FIGS. 2 to 4 consists of the housing 4, at least one load transfer element 8 disposed on a lower face 4.1 of the housing 4, the compressor 1 disposed vertically above the load transfer element 8 in the housing 4, and further heat pump components 3 also disposed in the housing 4, wherein a resilient insulating element (spring element 1.1) is disposed between the compressor 1 and the load transfer element 8.

In this heat pump it is preferred that a plurality of heat pump components 3 are positioned on the common support element 2 disposed vertically above a load transfer element 8, wherein a further resilient insulating element (spring element 2.1) is disposed between the support element 2 and the load transfer element 8.

It is preferred that the lower face 4.1 of the housing 4 is formed from a metal sheet disposed between the load transfer element 8 and the resilient insulating element (or the resilient insulating elements), see FIGS. 3 and 4. Moreover, it is preferred that the resilient insulating element is at least partially formed from an elastomer, preferably from polyurethane foam. Moreover, it is preferred that the compressor 1 is configured to be connected to the load transfer element 8 via at least three resilient insulating elements (preferably disposed on the corners of an imaginary triangle).

It is further preferred that two load transfer elements 8, are preferably disposed parallel to one another on the lower face 4.1 of the housing 4. The load transfer element 8 is also preferably configured to be at least three times, preferably six times, particularly preferably eight times, longer than it is wide or high, and/or the load transfer element 8 is preferably configured as a profile rail formed from sheet metal. Additionally, it is preferred that the compressor 1 and the support element 2 are assigned to the same load transfer element 8, see FIG. 2.

It is also preferred that a heat exchanger 5, preferably a plate heat exchanger, an expansion device 7, a valve device 6 and/or a refrigerant collector 9 are or is selectively disposed on the support element 2, see FIG. 4. It is also preferred that the support element 2 is configured to be plate-shaped, preferably from sheet metal. The plate-shaped support element 2 is configured to be provided with bent edges 2.2 on the edge side. This serves for stiffening the support element 2 and promotes the rigid-body vibration behavior of the heat pump. It is further preferred that the heat pump components 3 are disposed so as to be fastened to the support element 2. Moreover, the support element 2 is preferably and also configured to be connected to the load transfer element 8 without fixings, apart from the contact via the standing surfaces resulting from the arrangement above the load transfer element 8. Ultimately, this passive block simply stands on the load transfer element 8, wherein a lateral displacement is excluded, in particular, solely by the pipework to the compressor 1.

The heat pump shown in FIGS. 2 to 4 thus has a rigid-body behavior in its above-described embodiments, which leads to an effective insulation of the low-frequency vibrations generated by the heat pump components 3 and, in particular, the compressor 1. This substantially reduces the noise emission by the heat pump.

Figure 5:
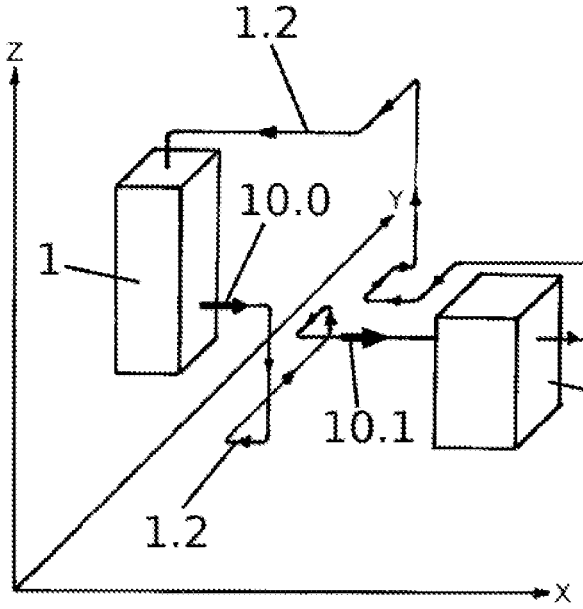
FIG. 5 shows schematically a heat pump with a fluid line wound in all directions between the compressor and a heat pump component.

The heat pump shown schematically in FIG. 5 consists of a compressor 1 which is configured to be connected via two refrigerant-conveying fluid lines 1.2 to the heat pump component 3, through which refrigerant flows, wherein each fluid line 1.2 has a longitudinal axis 1.2.1, (see FIG. 6), wherein an imaginary direction vector 10.1 which coincides with the longitudinal axis 1.2.1 points, on the route between the compressor 1 and the heat pump component 3, at least once in a different direction to an imaginary starting direction vector 10.0 which begins on the compressor 1 where it likewise coincides with the longitudinal axis 1.2.1, wherein the longitudinal axis 1.2.1 is configured to extend in a space with three imaginary, mutually perpendicular planes XY, XZ, YZ.

In order to eliminate as far as possible a transmission of vibrations from the compressor 1, which preferably comprises an electric motor, to the at least one heat pump component 3, it is thus preferably provided that the fluid line 1.2 is shaped such that the direction vector 10.1, on the route between the compressor 1 and the heat pump component 3, and with respect to all three planes XY, XZ, YZ, is configured to extend so as to be rotated at least once by an angle of 180° to the starting direction vector 10.0.

Considered as a whole, this proviso leads to an increase in the resilience or a reduction in the stiffness of the fluid line between the compressor and the heat pump component and thus to a reduced transmission of vibrations.

Figure 6:
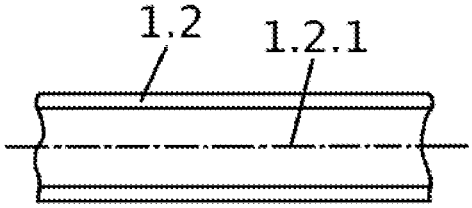
FIG. 6 shows a section through the fluid line according to FIG. 5.

The fluid line 1.2 is also preferably formed from a metallic material. Optionally, plastics is also preferably considered. The more resilient the material of the fluid line actually used per se, however, the less the approach as shown in FIGS. 5 and 6 is logically required.

For implementing a flow of the refrigerant which is as undisturbed as possible through the fluid line 1.2, it is also preferably provided that this fluid line is configured to be continually curved on all of its curved regions. The term "continually" is understood here in the mathematical sense. In other words, it is thus intended to be provided that the fluid line 1.2 has no sharp-edged kinks. In FIG. 5, the directional changes of the fluid line 1.2 are shown to be correspondingly rounded.

It is further preferably provided that, on the route between the compressor 1 and the heat pump component 3, the fluid line 1.2 is configured to be at least partially selectively guided around the compressor 1 and/or the heat pump component 3. This proviso which contributes further to the reduction in the transmission of vibrations applies to the fluid line 1.2 leading from the heat pump component 3 to the compressor 1 (as the corresponding arrows indicate).

As mentioned in the introduction, finally it is particularly preferably provided that the fluid line 1.2 is deflected not only by at least 180° but preferably by at least 270°. Quite particularly preferably, it is provided that the fluid line 1.2 is shaped such that the direction vector 10.1, on the route between the compressor 1 and the heat pump component 3, and with respect to one of the three planes XY, XZ, YZ, is configured to perform a full 360° turn in comparison with the starting direction vector 10.0. In FIG. 5 both fluid lines 1.2 shown precisely fulfil this proviso.

Figure 7:
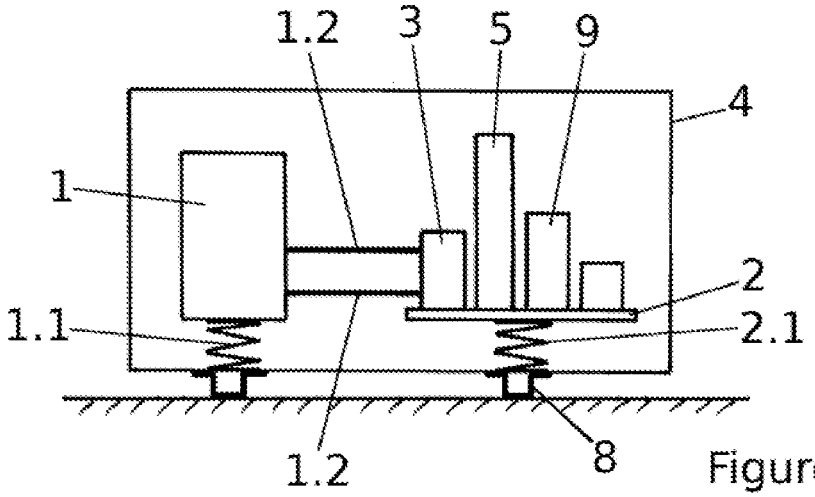
FIG. 7 shows schematically a heat pump with a decoupled compressor.

The heat pump shown in FIG. 7 preferably consists of the compressor 1 for compressing refrigerant and the heat pump components 3 through which refrigerant flows, wherein the compressor 1 for guiding the refrigerant via fluid lines 1.2 is configured so as to be connected to one of the further heat pump components 3, and wherein the compressor 1 and the further heat pump component 3 are configured to be connected via spring elements to a housing 4 of the heat pump for reducing a transmission of structure-borne sound.

It is preferably provided that the spring elements which are shown only schematically in FIG. 7 are (actually) formed at least partially from an elastomer, in particular polyurethane foam, i.e. as resilient insulating elements (spring elements 1.1, 2.1).

It is also preferably provided that a first fluid line 1.2 is configured as refrigerant supply line to the compressor 1 and a second fluid line 1.2 is configured as a refrigerant discharge line from the compressor 1.

It is also preferably provided that the fluid lines 1.2 are selectively formed from a material with a stiffness as a metallic material and/or from a metallic material.

It is also preferred that the compressor 1 and the further heat pump component 3 are configured to be fixedly connected together exclusively, on the one hand, via the fluid lines 1.2 which connect them together and, on the other hand, via resilient insulating elements connected to the housing 4 of the heat pump. This proviso leads to a particularly effective decoupling of the compressor from the other heat pump components and thus to a heat pump having very low noise.

Considered in even more detail, it is particularly preferably provided that the further heat pump component 3 is configured as valve device 6, in particular as a multi-way valve.

It is also particularly preferably provided that the further heat pump component 3 is positioned on a support element 2. It is further preferably provided that the support element 2 is configured to be connected via the spring elements 2.1 to the housing 4 of the heat pump. It is also further preferably provided that further heat pump components of the heat pump, such as a heat exchanger 5, an expansion device 7 and/or a refrigerant collector 9, are positioned on the support element 2. These further passive heat pump components 3 (since they do not produce vibrations themselves) advantageously form on the support element 2, as can be seen, an integrated subassembly which ultimately is excited to vibrate only via the fluid lines 1.2.

LIST OF REFERENCE SIGNS

1 Compressor
1.1 Spring element
1.2 Fluid line
1.2.1 Longitudinal axis
2 Support element
2.1 Spring element
2.2 Bent edge
3 Heat pump component
3.1 Pipework
4 Housing
4.1 Lower face
5 Heat exchanger
6 Valve device
Expansion device
8 Load transfer element
9 Refrigerant collector
10.0 Starting direction vector
10.1 Direction vector

The invention claimed is:

1. A heat pump comprising a compressor for compressing refrigerant and operating within an operating speed range to cause at least one disturbance frequency of a first order;

a unit comprising a support element and heat pump components disposed on the support element;

a fluid line between the compressor and the unit;

a housing; and first and second spring elements;

wherein the compressor is fastened via the first spring element directly to the housing and the support element is fastened by the second spring element directly to the housing;

wherein the support element comprises a plate;

wherein one of the heat pump components disposed on the support element is a refrigerant collector;

wherein the refrigerant flows through the heat pump components;

wherein the at least one disturbance frequency is transmitted by the compressor to the unit;

wherein the unit acts as a rigid body and has a first natural frequency greater than the at least one disturbance frequency; and wherein the compressor and the unit, apart from the fluid line between the compressor and the unit, are configured to be capable of vibration independently of one another.

2. The heat pump according to claim 1, wherein the support element has a first natural frequency which is greater than the at least one disturbance frequency of the first order caused by the compressor operating within the operating speed range.

3. The heat pump according to claim 1, wherein each heat pump component has a first natural frequency which is greater than the at least one disturbance frequency of the first order caused by the compressor operating within the operating speed range.

4. The heat pump according to claim 1, further comprising a pipework of the heat pump components, wherein the unit, including the pipework of the heat pump components, has a first natural frequency which is greater than the at least one disturbance frequency of the first order transmitted by the compressor operating within the operating speed range to the unit acting as the rigid body.

5. The heat pump according to claim 1, wherein each of the first and second spring elements is formed at least partially from an elastomer.

6. The heat pump according to claim 1, wherein a center of gravity of the unit is selected such that a weight force is vertically introduced into the second spring element.

7. The heat pump according to claim 1, wherein the compressor has an operating speed range of 700 to 7200 revolutions per minute.

8. The heat pump according to claim 1, wherein the unit has a first natural frequency of more than 100 Hz.

9. The heat pump according to claim 1, wherein the compressor has an operating speed range of 800 to 6900 revolutions per minute.

10. The heat pump according to claim 1, wherein the compressor has an operating speed range of 900 to 6600 revolutions per minute.

11. The heat pump according to claim 1, wherein the unit has a first natural frequency of more than 120 Hz.

12. The heat pump according to claim 1, wherein the unit has a first natural frequency of more than 140 Hz.

13. The heat pump according to claim 1, wherein the plate has at least one bent edge.

14. The heat pump according to claim 1, further comprising a load transfer element disposed on a lower face of the housing, wherein the load transfer element comprises a rail.

15. The heat pump according to claim 1, wherein the heat pump components further comprise a valve device; and wherein the compressor is situated adjacent to the plate on which the heat pump components including the valve device and the refrigerant collector are mounted.

* * * * *